US009188400B2

(12) United States Patent
Crouse

(10) Patent No.: US 9,188,400 B2
(45) Date of Patent: Nov. 17, 2015

(54) SYSTEM AND METHOD FOR CHARGING A WEAPON

(71) Applicant: The United States of America as represented by the Secretary of the Navy, Washington, DC (US)

(72) Inventor: Adam Crouse, Shoals, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/667,625

(22) Filed: Mar. 24, 2015

(65) Prior Publication Data

US 2015/0276337 A1 Oct. 1, 2015

Related U.S. Application Data

(60) Provisional application No. 61/969,466, filed on Mar. 24, 2014.

(51) Int. Cl.
*F41A 3/72* (2006.01)
*F41A 7/02* (2006.01)

(52) U.S. Cl.
CPC .... *F41A 3/72* (2013.01); *F41A 7/02* (2013.01)

(58) Field of Classification Search
CPC ..... F41A 3/72; F41A 7/08; F41A 23/24; F41A 7/02
USPC ..... 89/1.4
See application file for complete search history.

(56) References Cited

U.S. PATENT DOCUMENTS 2,202,232 A * 5/1940 Rossmanith ..... F41A 7/02 89/1.4
2,389,737 A * 11/1945 Neuschotz ..... F41A 19/08 74/506
2,406,461 A * 8/1946 Hammell ..... F41A 7/06 318/445
2,408,110 A * 9/1946 Thresh ..... F41A 7/02 89/1.4
2,468,216 A 4/1949 MacDonald
3,363,351 A 1/1968 Smith
3,635,123 A 1/1972 Colby
4,011,794 A 3/1977 Leshem
4,421,006 A * 12/1983 Kocher ..... F41A 7/02 89/1.4

(Continued)

FOREIGN PATENT DOCUMENTS

CN 103175441 A 6/2013
WO WO 2008/099352 A1 8/2008

OTHER PUBLICATIONS

Product literature: AAV7A1 Assault Amphibious Vehicle; BAE Systems, Inc., © 2011; 2 pages.

(Continued)

*Primary Examiner* — Troy Chambers
*Assistant Examiner* — Joshua Semick
(74) *Attorney, Agent, or Firm* — Christopher A. Monsey

(57) ABSTRACT

A system and method for charging a weapon. In an illustrative embodiment, a charging assembly attaches to the side of an MK19 grenade launcher. The charging assembly includes a chain that attaches at one end to the charging bolt of the MK19 grenade launcher. The other end of the chain attaches to a crank assembly. The crank assembly includes a handle and a sprocket that rotate around a pivot axis, pulling on the chain and the charging bolt. The sprocket is large enough that the charging bolt is fully drawn by rotating the handle and the sprocket less than one full rotation around the pivot axis.

33 Claims, 12 Drawing Sheets

(56) References Cited

U.S. PATENT DOCUMENTS

| | | | | |
|---|---|---|---|---|
| 4,531,444 | A * | 7/1985 | Jackson | F41A 7/02 89/1.4 |
| 4,539,890 | A | 9/1985 | Bosshard | |
| 4,974,491 | A | 12/1990 | von Laar et al. | |
| 5,691,497 | A | 11/1997 | Weichert et al. | |
| 6,095,026 | A | 8/2000 | Poussard et al. | |
| 6,142,058 | A | 11/2000 | Mayville et al. | |
| 6,591,535 | B2 | 7/2003 | Reynolds | |
| 7,526,991 | B2 | 5/2009 | Steimke et al. | |
| 7,975,595 | B2 | 7/2011 | Robinson et al. | |
| 8,794,121 | B2 | 8/2014 | Steimke et al. | |
| 8,820,212 | B2 | 9/2014 | Rostocil | |

OTHER PUBLICATIONS

Field Manual 3-22.27: MK 19, 40 mm Grenade Machine Gun, MOD 3, Nov. 2003, Headquarters, Department of the Army; 139 pages.

* cited by examiner

SYSTEM AND METHOD FOR CHARGING A WEAPON

CROSS-REFERENCE TO RELATED APPLICATION

This application claims the benefit of U.S. Provisional Patent Application Ser. No. 61/969,466, filed Mar. 24, 2014, the disclosure of which is expressly incorporated herein by reference.

STATEMENT REGARDING FEDERALLY SPONSORED RESEARCH OR DEVELOPMENT

The invention described herein may be manufactured, used and licensed by or for the United States Government for any governmental purpose without payment of any royalties thereon. This invention (NC 103,112) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to a system and method for charging a bolt on a weapon, illustratively a grenade launcher, such as the MK19, 40 mm grenade machine gun mounted to the turret of an assault amphibious vehicle (AAV). Prior weapon charging systems involved cranking assemblies that required an operator to turn a crank multiple revolutions in order to achieve the stroke needed to fully draw back the bolt on the MK19 grenade launcher. These systems were not only time consuming, but also took significant effort to execute. Space is very limited within a turret of an assault amphibious vehicle (AAV), and previous systems occupied a space that is in close contact with the operator. Previous systems attached to the inner ring of the AAV turret. This placed the charging system directly in line with the hip of the gunner, which resulted in both loss of valuable space and created a possibility of gear damage and/or personal injury.

One aspect or embodiment of the present disclosure addresses time and effort concerns by providing a cranking system that fully charges the bolt on the MK19 grenade launcher by turning a handle less than one full revolution. Another aspect or embodiment of the present disclosure addresses space and safety concerns by locating the cranking system above the turret ring, directly behind the weapon, and out of the way of the operator.

According to an illustrative embodiment of the present disclosure, a system for charging a bolt of a grenade launcher is provided, wherein the bolt of the grenade launcher is charged when the bolt is fully drawn along a linear path. The system includes a charging assembly including a frame attachable to the grenade launcher, a chain supported by the frame and extending between a proximal end and a distal end, the distal end of the chain being configured to move a bolt of the grenade launcher. The system further includes a crank assembly operably coupled to the charging assembly, the crank assembly including a handle, a sprocket, and a pivot pin coupled to the handle and the sprocket for rotating the handle and the sprocket about a pivot axis defined by the pivot pin. The proximal end of the chain is coupled to the sprocket at a sprocket radius from the pivot axis such that when the handle and the sprocket rotate around the pivot axis, the chain moves the bolt along a linear draw length, and the sprocket radius has a value large enough such that rotating the handle and the sprocket by an angle of rotation less than one full rotation around the pivot axis defines an arc length sufficient to fully draw the charging bolt along the linear draw length.

According to another illustrative embodiment of the present disclosure, a system for charging a bolt of a grenade launcher is provided, wherein the charging bolt of the grenade launcher is charged when the bolt is fully drawn along a linear path. The system includes a charging assembly includes a frame attachable to the grenade launcher, a flexible coupling supported by the frame and extending between a proximal end and a distal end, a charger block coupled to the distal end of the flexible coupling and configured to engage the charging bolt of the grenade launcher. A crank assembly is operably coupled to the charging assembly. The crank assembly includes a sprocket coupled to the proximal end of the flexible coupling, and a handle coupled to the sprocket for rotating the sprocket about a pivot axis. Rotation of the sprocket by an angle of rotation less than 180 degrees about the pivot axis by a pull force of less than 40 lbs. is configured to transmit at least 60 lbs. of pull force on the charging bolt through the charger block to fully draw the charging bolt along the linear path.

According to a further illustrative embodiment of the present disclosure, a method of assembling a charging system for a grenade launcher includes the steps of securing mounting pins onto a frame, such that the distance between the mounting pins is substantially the same as the distance between pre-existing mounting sockets on a grenade launcher, attaching a charger block for sliding movement within a longitudinally extending slot in the frame, and attaching a spring to the charger block. The method further includes the steps of attaching a distal end of a chain to a chain attachment, and coupling the chain attachment to the charger block. The method further includes the steps of installing a pivot pin into a mounting bracket, attaching a handle to the pivot pin for rotation about a pivot axis, attaching a sprocket to the pivot pin for rotation with the handle about the pivot axis, and attaching a proximal end of the chain to the sprocket.

According to another illustrative embodiment of the present disclosure, a method of charging a weapon includes the steps of providing a charging assembly including a charger block operably coupled to a chain, and providing a crank assembly including a rotatable sprocket operably coupled to the chain of the charging assembly, and a handle configured to rotate the sprocket. The method further includes the step of rotating the handle and the sprocket rearwardly by less than 360 degrees, wherein the charger block engages a charging bolt on the weapon and moves rearwardly by a linear draw length of the weapon.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
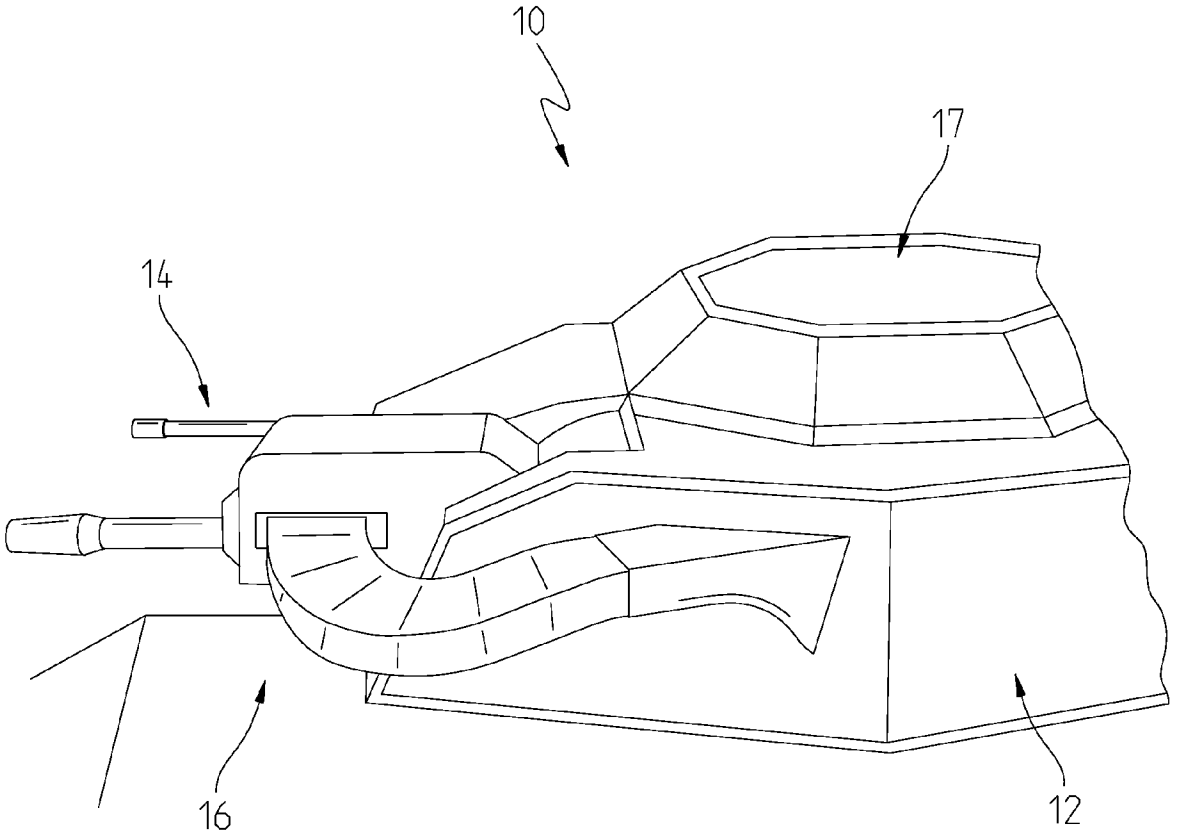
Fig. 1 (Prior Art)
FIG. 1 is a perspective view of an assault amphibious vehicle (AAV) including a turret supporting a grenade launcher.

Referring initially to FIG. 1, an assault amphibious vehicle (AAV) 10 is shown as including a turret 12 supporting a machine gun 14 (illustratively a .50 caliber machine gun) and a grenade launcher 16 (illustratively an MK19 40 mm grenade machine gun). As is known, the turret 12 defines an opening 17 to receive an operator. The AAV 10 may comprise an AAV7A1 vehicle as manufactured by BAE Systems, Inc. of Arlington, Va.

Figure 2:
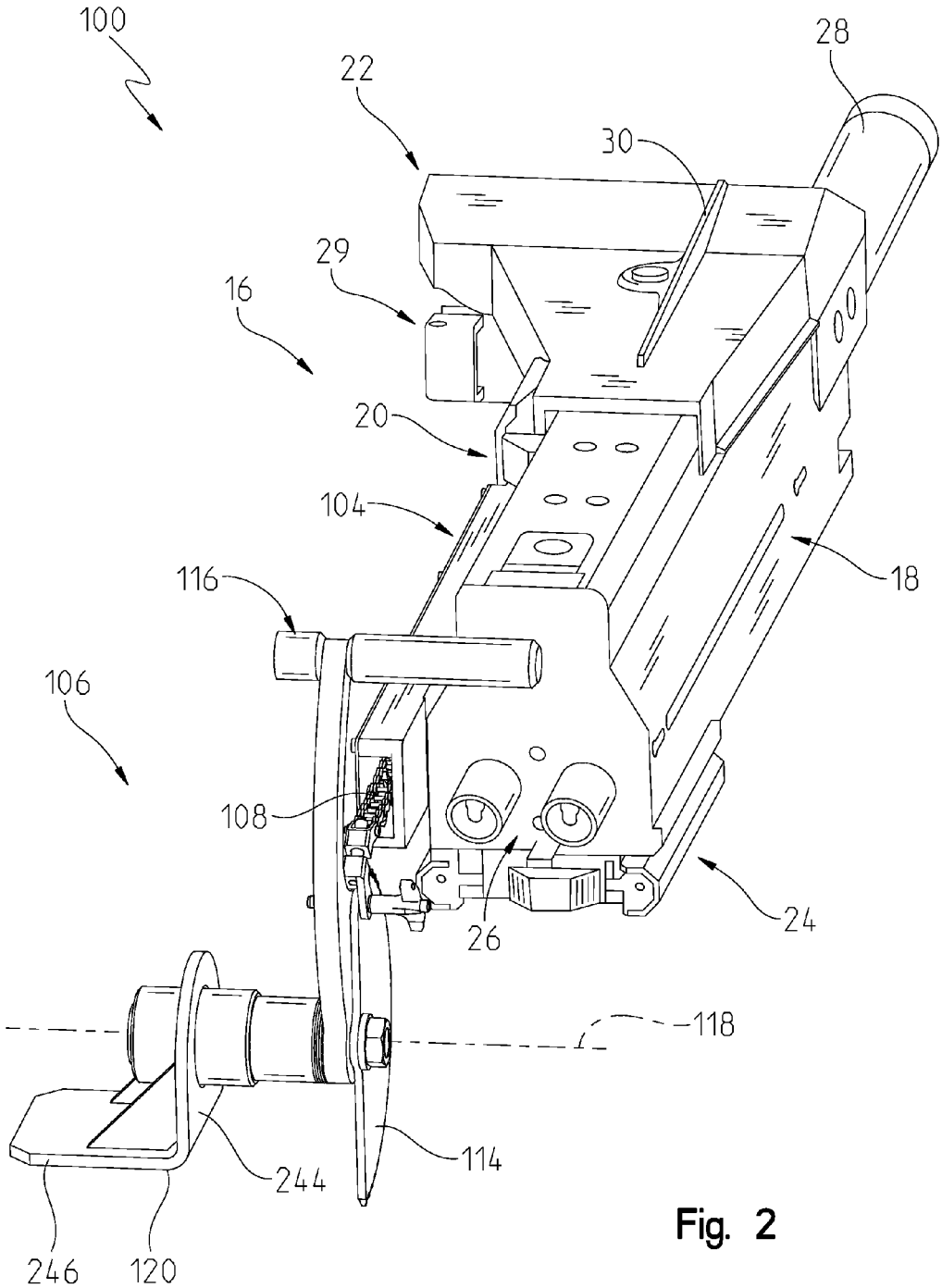
FIG. 2 is a perspective view of a system for charging a grenade launcher according to an illustrative embodiment of the disclosure.
Figure 3:
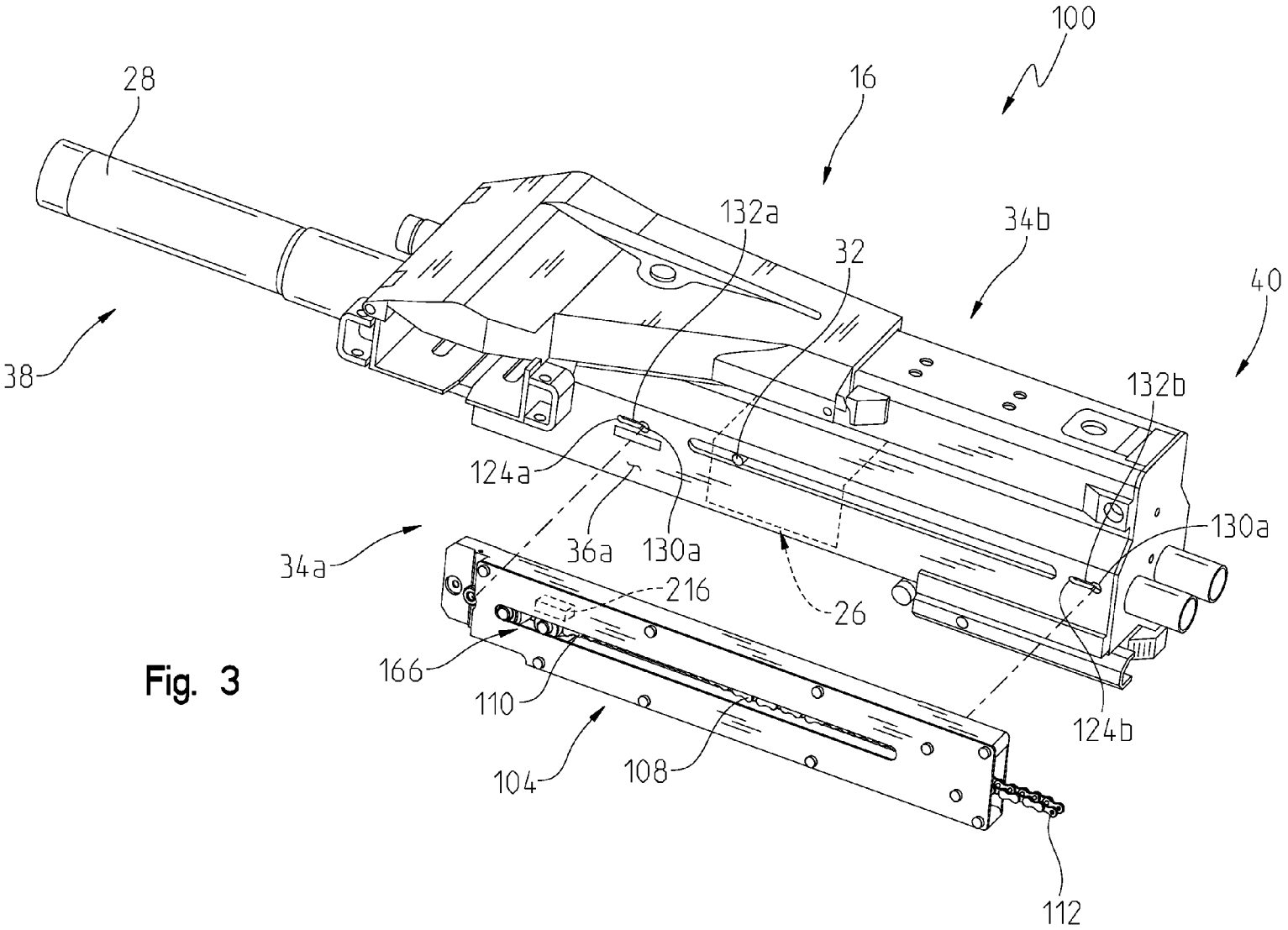
FIG. 3 is a perspective view of the charging assembly of FIG. 2 removed from the grenade launcher.

With reference to FIGS. 2 and 3, the MK19 grenade launcher 16 illustratively includes a receiver assembly 18, a feed slide assembly 20, a top cover assembly 22, a sear assembly 24 and a bolt and backplate assembly 26. The receiver assembly 18 supports a barrel 28, wherein grenades are illustratively fed into the left side of the receiver assembly 18 through a feed throat assembly 29. The feed slide assembly 20 holds rounds in a feeder and indexes the grenades (as interconnected in an ammunition belt) into position for delinking. The top cover assembly 22 holds the feed slide assembly 20 and supports a front sight 30. The bolt and backplate assembly 26 includes a charging bolt 32 for firing a grenade from the barrel 28 when the sear assembly 24 is depressed by trigger action. The sear assembly 24 holds a receiver sear, wherein trigger action releases the sear and allows the charging bolt 32 to move forward.

The MK19 grenade launcher 16 cycle of operation illustratively includes six steps, including charging, extracting or delinking, cocking, firing, blowback, and automatic feeding. During the charging step, the bolt 32 is pulled to a rear or proximal end of the grenade launcher 16, thereby aligning the round with bolt extractors (not shown). Additional details on the structure and operation of the MK19 grenade launcher are provided in MK 19, 40-mm Grenade Machine Gun, MOD 3 (FM 3-22.27, published by the U.S. Department of the Army in November 2003, the disclosure of which is expressly incorporated herein by reference.

Referring further to FIG. 2, a system 100 for charging an MK19 grenade launcher 16 according to an illustrative embodiment of the invention is shown. The system 100 for charging the MK19 grenade launcher includes a charging assembly 104 and a crank assembly 106.

As noted above, the MK19 grenade launcher 16 includes a charging bolt 32. In order for the weapon 16 to be fired, the charging bolt 32 must be fully drawn (i.e., moved axially rearwardly by a predefined draw length (DL)) to its charged position. The charging assembly 104 is attached to the MK19 grenade launcher 16. The charging assembly 104 includes a flexible coupling, illustratively a chain 108 having a distal end 110 that is engagable with the charging bolt 32. The proximal end 112 of the chain 108 is attached to a user interface, illustratively a sprocket 114 of the crank assembly 106. The crank assembly 106 includes a handle 116 coupled to the sprocket 114 that together rotate around a pivot axis 118 located on a mounting bracket 120. When the handle 116 and the sprocket 114 rotate downwardly and rearwardly around the pivot axis 118, the chain 108 pulls on the charging bolt 32. As further detailed herein, the radius of the sprocket 114 is large enough such that the charging bolt 32 is fully drawn by rotating the handle 116 and the sprocket 114 less than one full rotation (i.e., 360 degrees) around the pivot axis 118.

Referring further to FIG. 3, the charging assembly 104 includes a body or frame 121 having mounting pins 122*a* and 122*b* designed to be received by mounting sockets 124*a* and 124*b* of the grenade launcher 16. The frame 121 further supports a spring-loaded pin 126 that, when decompressed, protrudes adjacent to the mounting pin 122*a* designed to be received by mounting socket 124*a* and, when compressed, is fully recessed into the frame 121 of the charging assembly 104. The mounting sockets 124*a* and 124*b* include circular openings 130*a* and 130*b* and sliding tracks 132*a* and 132*b*. The mounting sockets 124*a* and 124*b* come pre-manufactured on the MK19 grenade launcher 16. Each mounting pin 122*a* and 122*b* illustratively includes a shaft 134*a*, 134*b* and an enlarged head 136*a*, 136*b*.

In operation, the frame 121 of the charging assembly 104 is illustratively mounted to a left side 34*a* of the MK19 grenade launcher 16. Alternatively, the charging assembly 104 may be mounted to a right side 34*b* of the MK19 grenade launcher 16. The mounting pins 122*a* and 122*b* are illustratively welded to the frame 121 of the charging assembly 204. The heads 136*a* and 136*b* of the mounting pins 122*a* and 122*b* are small enough to fit through the circular openings 130*a* and 130*b* of the mounting sockets 124*a* and 124*b*. The diameter of the base or shaft 134*a* and 134*b* of each mounting pin 122*a* and 122*b* is small enough that the pins 122*a* and 122*b* can slide along the sliding tracks 132*a* and 132*b* of the mounting sockets 124*a* and 124*b*.

The frame 121 of the charging assembly 104 is placed adjacent to the MK19 grenade launcher 16 such that the mounting pins 122*a* and 122*b* are inserted into the circular openings 130*a* and 130*b* of the mounting sockets 124*a* and 124*b*, and so that the spring-loaded pin 126 is pressed up against the outer surface 36*a* of the left side 34*a* of the MK19 grenade launcher 16 and is fully compressed into the frame 12 of the charging assembly 104. The frame 12 of the charging assembly 104 is moved forward toward a front or distal end 38 (i.e., away from the rear or proximal end 40) of the MK19 grenade launcher 16, such that the mounting pins 122*a* and 122*b* slide along the sliding tracks 132*a* and 132*b* of the mounting sockets 124*a* and 124*b*. Once the mounting pins 122*a* and 122*b* slide completely forward along the sliding tracks 132*a* and 132*b* toward the front of the weapon 16, the spring-loaded pin 126 extends into the circular opening 130*a* of the mounting socket 124*a* and locks the frame 12 of the charging assembly 104 in place.

In another illustrative embodiment, the charging assembly 104 includes a second spring-loaded pin (not shown) supported adjacent to the mounting pin 122*b* designed to be received by mounting socket 124*b*. In operation, the frame 121 of this illustrative charging assembly 104 is locked into place when both the first spring-loaded pin 126 extends into circular opening 130*a* of mounting socket 124*a* and the second spring-loaded pin extends into circular opening 130*b* of mounting socket 124*b*.

In operation, the MK19 grenade launcher 16 may be mounted to vehicle turret 12. The frame 121 of the charging assembly 104 is mounted to the side 34*a* of the MK19 grenade launcher 16. The mounting bracket 120 is welded to an inside surface of the vehicle turret 12 such that the crank assembly 106 is located behind the MK19 grenade launcher 16 and the sprocket 114 is aligned with the chain 108 that is housed by the frame 121 of the charging assembly 104. Distal end 110 of the chain 108 is operably coupled to the charging bolt 32 of the MK19 grenade launcher 16. Proximal end 112 of the chain 314 is attached to a chain adapter 142 using a screw 144 and a nut 146. The chain adapter 142 is attached to the sprocket 114 using a quick release pin 148, such that the chain 108 can be quickly connected or disconnected during maintenance and/or assembly. The quick release pin 148 illustratively includes ball detents 150 that may be retracted by depressing a release button 152.

Figure 5:
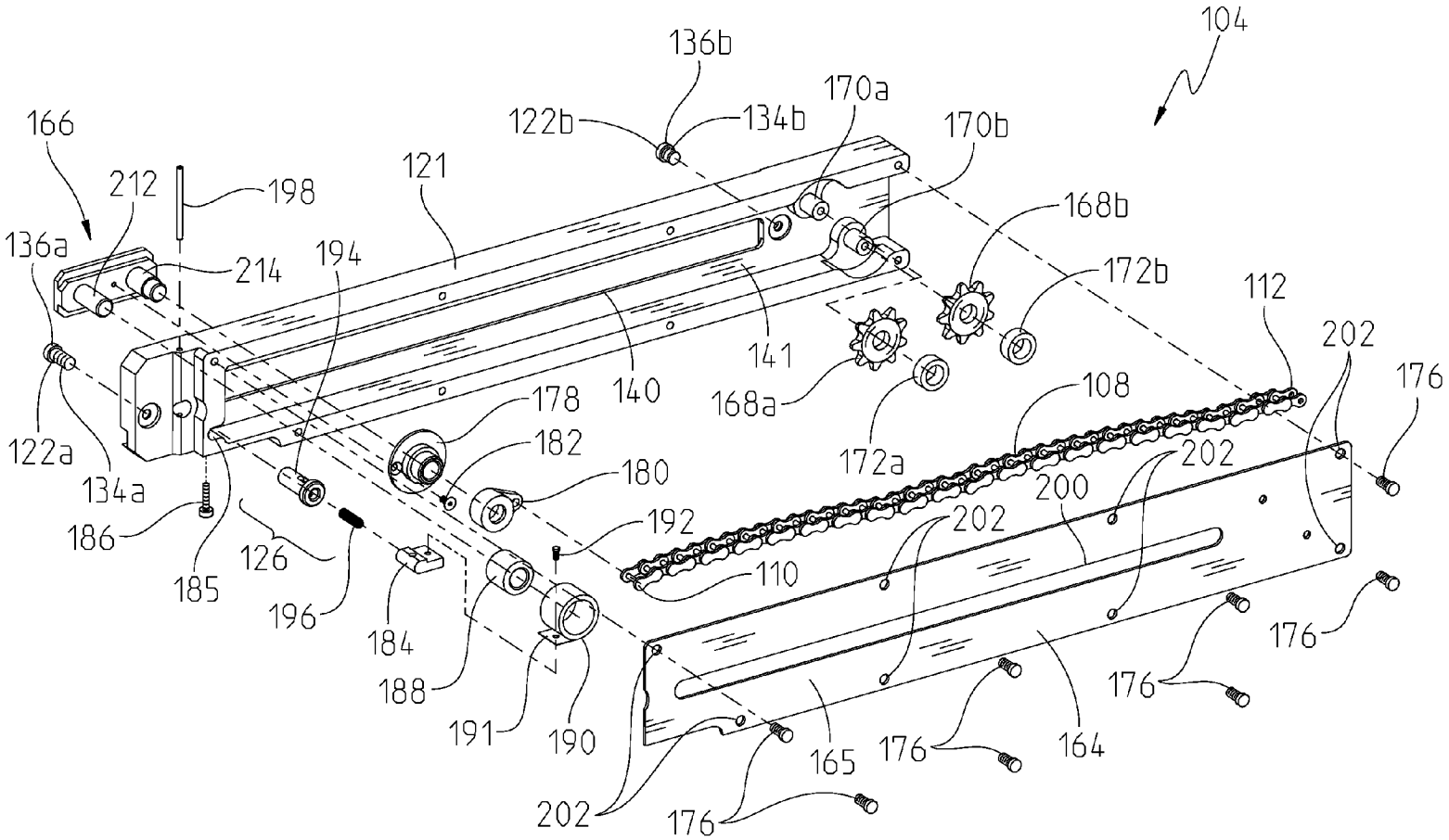
FIG. 5 is an exploded perspective view of the charging assembly of FIG. 3.

Referring to FIG. 5, an exploded perspective view of the charging assembly 104 of system 100 for charging an MK19 grenade launcher 16 according to an illustrative embodiment of the invention is shown. The charging assembly 104 illustratively includes frame 121, a faceplate 164, a charger block 166, mounting pins 122*a* and 122*b*, chain 108, sprockets 168*a* and 168*b*, sprocket spacers 172*a* and 172*b*, faceplate screws 176, a charger nut 178, a chain attachment 180, a charger nut screw 182, a plug 184, a plug screw 186, a coil spring spacer 188, a coil spring 190, a coil spring screw 192, a spring-loaded pin 194, a spring 196, and a locking pin 198. The frame 121 illustratively includes longitudinally extending rectangular opening or slot 140 on its rear face or section 141 with a length at least equal to the distance required to fully draw the MK19 charging bolt 32 (i.e., length DL). The faceplate 164 also includes a longitudinally extending rectangular opening or slot 200 and a plurality of threaded holes 202 on its front face or section 165 designed to receive the faceplate screws 176. The frame 121 supports front and rear sprocket mounts 170*a* and 170*b* for receiving front and rear sprockets 168*a* and 168*b* and sprocket spacers 172*a* and 172*b*. The sprockets 168*a* and 168*b* are supported for rotation on the mounts 170*a* and 170*b*, respectively.

During manufacture and assembly of the charging assembly 104, the mounting pins 122*a* and 122*b* are illustratively welded onto frame 121 such that the distance between the mounting pins 122*a* and 122*b* is substantially the same as the distance between the pre-exiting mounting sockets 124*a* and 124*b* that come standard on the MK19 grenade launcher 16. The heads 136*a* and 136*b* of the mounting pins 122*a* and 122*b* are smaller in diameter than the circular openings 130*a* and 130*b* in the mounting sockets 124*a* and 124*b*, and the bases or shafts 134*a* and 134*b* of the mounting pins 122*a* and 122*b* are smaller in diameter than the sliding track 132*a* and 132*b* of the mounting sockets 124*a* and 124*b* so that the mounting pins 122*a* and 122*b* can be received by the mounting sockets 124*a* and 124*b* (FIG. 3). Mounting pin 122*a* is welded near the front or distal end of the charging assembly 104, and mounting pin 122*b* is welded near the rear or proximal end of the charging assembly 104. Sprockets 168*a* and 168*b* are mounted on the frame 121 near the rear of the charging assembly 104 such that when the chain 108 is run through the sprockets 168*a* and 168*b*, the chain 108 runs parallel with the length or longitudinal axis of the frame 121. Sprocket spacers 172*a* and 172*b* are mounted against the sprockets 168*a* and 168*b* to keep the sprockets 168*a* and 168*b* from sliding side to side. The faceplate 164 is attached to the frame 121 using the plurality of faceplate screws 176.

The back side of the charger block 166 has a protruding catch 216 designed to engage or catch the head of the MK19 charging bolt 32, such that when the charger block 166 is pulled toward the rear of the charging assembly 104, the MK19 charging bolt 32 is drawn back toward the rear or proximal end of the weapon 16. The front side of the charger block 166 has two protruding pins 212 and 214 that slide axially through the rectangular opening or slot 140 in the frame 121. The charger nut 178 slides onto the rear pin 214 and is attached to the charger block 176 by the charger nut screw 182. The diameter of the charger nut 178 is larger than the width of the slot 140 in the frame 121, so the charger nut 178 prevents the charger block 176 from sliding out of the frame 121.

The chain attachment 180 slides onto the rear pin 214 of the charger block 176 on top of the charger nut 178 and is held in place by the faceplate 164. The chain 108 attaches to the chain attachment 180 so that when the proximal end 112 of the chain 108 is pulled, the chain attachment 180, the charger nut 178, and the charger block 176 are also pulled on by the chain 108. The plug 184 slides into a notch 185 in the frame 121 and is secured by the plug screw 186. The coil spring 190 slides onto the front pin 212 of the charger block 176. The coil spring spacer 188 is inserted between the coil spring 190 and the front pin 212 of the charger block 176. The purpose of the coil spring spacer 188 is to provide that the coil spring 190 fits snugly onto the front pin 212 of the charger block 176. The end 191 of the coil spring 190 is secured to the plug 184 by the coil spring screw 192.

When an operator pulls on the chain 108 through the crank assembly 106, the charger block 176 is pulled to the rear or proximal end of the frame 121, and the coil spring 190 uncoils. When the chain 108 is released, the coil spring 190 recoils and pulls the charger block 176 back towards the front or distal end of the frame 121. The spring-loaded pin 194 and the spring 196 slide into an opening in the frame 121. The locking pin 198 slides through another opening in the frame 121 that perpendicularly intersects the opening with the spring-loaded pin 194 and the spring 196. The locking pin 198 prevents the spring-loaded pin 194 and the spring 196 from sliding out the face of the frame 121. When the charging assembly 104 is pressed against the MK19 grenade launcher 16, the side of the grenade launcher 16 forces the spring-loaded pin 194 to compress the spring 196. When the charging assembly 104 is properly mounted to the grenade launcher 16, the mounting pins 122*a* and 122*b* slide forward into the mounting sockets 124*a* and 124*b*, and the spring-loaded pin 194 lines up with the circular opening 130*a* of the front mounting socket 124*a*. The spring 196 pushes the spring-loaded pin 194 into the circular opening 130*a* of the front mounting socket 124*a*, locking the charging assembly 104 in place.

Referring to FIGS. 7A-7E, additional details of the charger block 166 according to an illustrative embodiment of the invention are shown. The charger block 166 includes a base 210, front pin 212, rear pin 214 and catch 216. With reference to FIG. 5, the rear pin 214 and the front pin 212 are inserted into rectangular opening or slot 140 in the frame 121 of the charging assembly 104. The rear pin 214 has a wider diameter at its base or shaft than at its head. The wide base or shaft of the rear pin 214 receives the charger nut 178 which prevents the charger block 176 from falling out of the rectangular opening or slot 140 in the charging assembly 104. The head of the rear pin 214 receives the chain attachment 180 which allows chain 108 to be coupled to the rear pin 214. The front pin 212 receives the coil spring 190 which biases the charger block 176 back towards the front or distal end of the MK19 grenade launcher 16 after the charging bolt 32 is drawn. When the charging assembly 104 is mounted on the MK19 grenade launcher 16, the catch 216 is inserted into the slot 140 in the side of the grenade launcher 16 such that the catch 216 engages or catches the charging bolt 32 of the grenade launcher 16 when the charger block 176 is drawn back in an axial direction from a forward or distal position to a rearward or proximal position.

Figure 8:
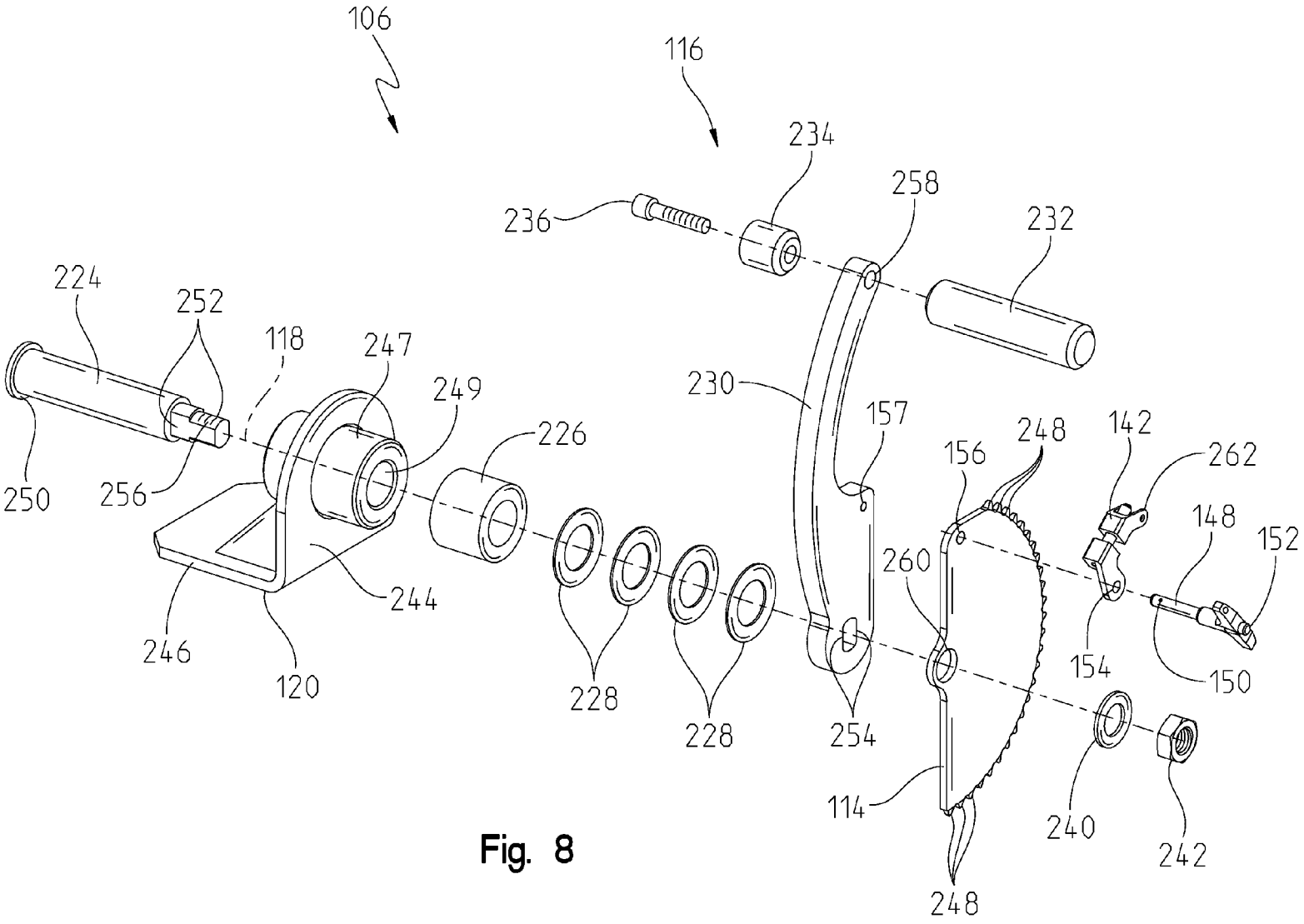
FIG. 8 is an exploded perspective view of the crank assembly of the system of FIG. 2.

Referring to FIG. 8, an exploded perspective view of a crank assembly 106 of a system for charging a MK19 grenade launcher 16 according to an illustrative embodiment of the invention is shown. The crank assembly 106 of a system for charging the MK19 grenade launcher 16 includes a mounting bracket 120, a pivot pin 224, a spacer 226, adjustment spacers 228, a handle arm 230, a grip 232, a dead stop 234, a bolt 236, sprocket 114, a washer 240, a nut 242, chain adapter 142, and quick release pin 148.

During manufacture and assembly, the mounting bracket 120 is welded onto an inner surface of the vehicle turret 12 behind the MK19 grenade launcher 16 with the charging assembly 104 attached (FIGS. 2-5). The mounting bracket 120 illustratively includes an upright 244 supported by a base 246. The upright 244 supports a bushing 247 defining a circular opening 249. The pivot pin 224 slides into the circular opening 249 of the bushing 247 for rotation therein. A first end of the pivot pin 224 includes an enlarged head 250 with a diameter larger than the opening 249 in bushing 247 so that the pivot pin 224 cannot slide all the way through the opening 249. An opposing second end of the pivot pin 224 is keyed in such a manner that when pivot pin 224 is inserted into the handle 116 and the sprocket 114, the handle 116 and the sprocket 114 cannot freely rotate around the pivot pin 224. The key between the pivot pin 224 and the handle 116 is illustratively defined by cooperating flats 252 and 254 defined by the second end of the pivot pin 224 and a lower opening in the arm 230, respectively. The keyed end of the pivot pin 224 supports external threads 256 such that the nut 242 can be screwed onto the end of the pivot pin 224.

In between the opposing ends of the pivot pin 224, the shaft of the pivot pin 224 is cylindrical with a smooth surface such that the pivot pin 224 can rotate freely within the opening 249 in the mounting bracket 120 about pivot axis 118. The spacer 226 and the adjustment spacers 228 slide onto the pivot pin 224. The spacer 226 and the adjustment spacers 228 offset the handle 116 and the sprocket 114 from the mounting bracket 120 so that when the handle 116 and the sprocket 114 are attached to the keyed end of the pivot pin 224, the handle 116 is flush against the spacer 226 and/or at least one of the adjustment spacers 228. The adjustment spacers 228 are significantly thinner than the spacer 226 and may be used to fine tune the lateral position of the handle 116 and the sprocket 114 so that the sprocket 114 is substantially axially aligned with the sprockets 168*a* and 168*b* in the charging assembly 104 (FIG. 5). In order to move the handle 116 and the sprocket 114 all the way to the right, all of the adjustment spacers 228 are installed between the mounting bracket 120 and the handle 116. In order to adjust the handle 116 and the sprocket 114 to the left, one or more of the adjustment spacers 228 are instead installed between the head 250 of the pivot pin 224 and the mounting bracket 120.

As noted above, lower end of the arm 230 of the handle 116 has a keyed opening 254 designed to receive the keyed end (i.e., flats 252) of the pivot pin 224. The upper end of the arm 230 of the handle 116 includes a circular hole 258 designed to receive bolt 236. The bolt 236 is inserted through the dead stop 234, through the circular hole 258 in the arm 230, and is screwed into a threaded opening in the grip 232, such that the grip 232 is secured flush against the arm 230.

The sprocket 114 includes a hole 260 (which may be keyed) configured to receive the keyed end of the pivot pin 224. The washer 240 and the nut 242 secure the handle 116 and the sprocket 114 for rotation with the pivot pin 224 by screwing the nut 242 onto the threaded, keyed end of the pivot pin 224. The handle 116 and the sprocket 114 include aligned openings 157 and 156 to receive the quick release pin 148. Illustratively, when the handle 116 and the sprocket 114 are mounted onto the keyed end of the pivot pin 224, the openings 157 and 156 align.

The chain adapter 142 has a circular hole 154 at one end. The circular hole 154 in the chain adapter 142 is aligned with the openings 157 and 156 in the handle 116 and the sprocket 114, and the quick release pin 148 is inserted through the openings 157, 156 and 154 in the handle 116, the sprocket 114, and the chain adapter 142. This secures the chain adapter 142 to the sprocket 114 and further secures the sprocket 114 to the handle 116.

A chain connecting end 262 of the chain adapter 142 is designed to attach to the proximal end 112 of the chain 108. The circular hole 154 in the chain adapter 142 is offset from the chain connecting end 262 of the chain adapter 142 such that when the chain adapter 142 is secured to the sprocket 114 and when a chain 108 is attached to the chain connecting end 262 of the chain adapter 142, gaps 264 in the chain links 266 are properly aligned with the teeth 248 of the sprocket 114. The sprocket 114 is a segmented sprocket (e.g., semi-circular) rather than a full circular sprocket. This is because when the handle 116 rotates the sprocket 114 and pulls the chain 108 which is attached to the charging bolt 32 of the MK19 grenade launcher 16, the charging bolt 32 is fully drawn before the sprocket 114 makes a full rotation (i.e., 360 degrees) about the pivot axis 118. Given the confined space within the vehicle turret 12, and to prevent interference with the inner ring of the turret 12, it is desired that the weapon 16 be fully charged by rotating the handle 116 and sprocket 114 by less than 180 degrees.

Figure 6A:
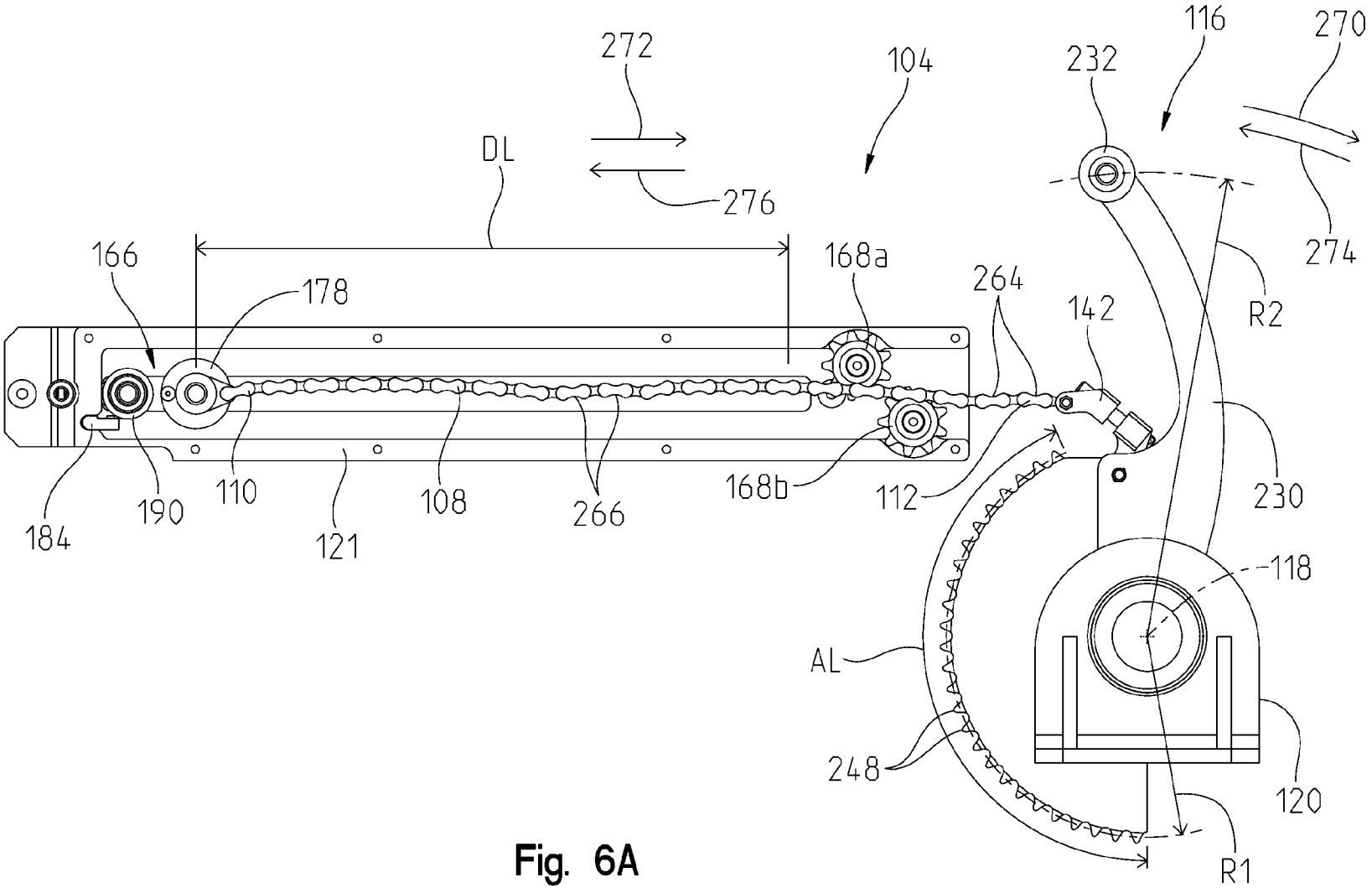
FIG. 6A is a first side view of the charging assembly of FIG. 5.
Figure 6B:
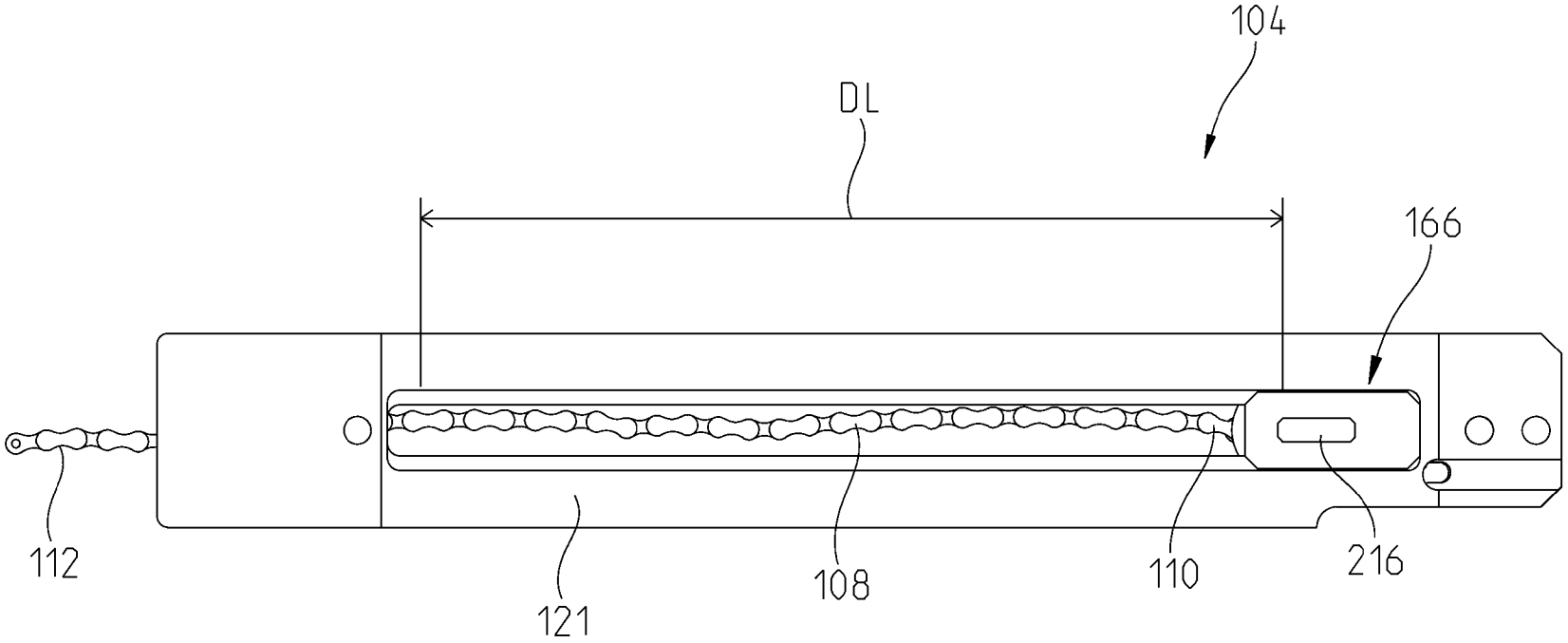
FIG. 6B is a second side view of the charging assembly of FIG. 5.
Figure 7A:
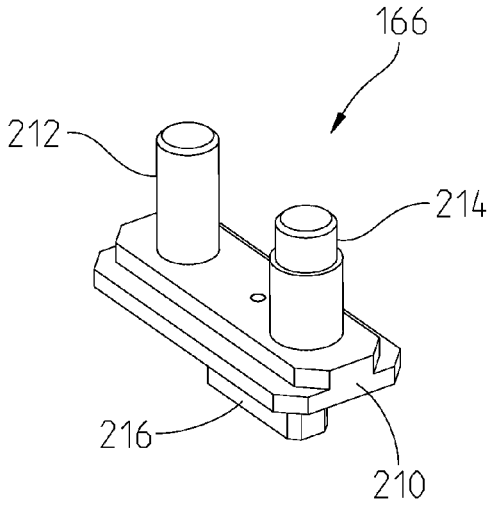
FIG. 7A is a perspective view of a charger block of the illustrative embodiment charging assembly of FIG. 5.
Figure 7D:
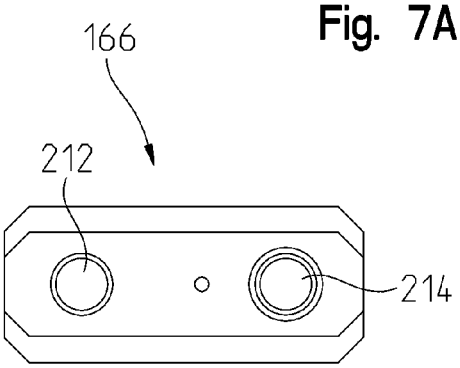
FIG. 7D is a top plan view of the charger block of FIG. 7A.
Figure 7B:
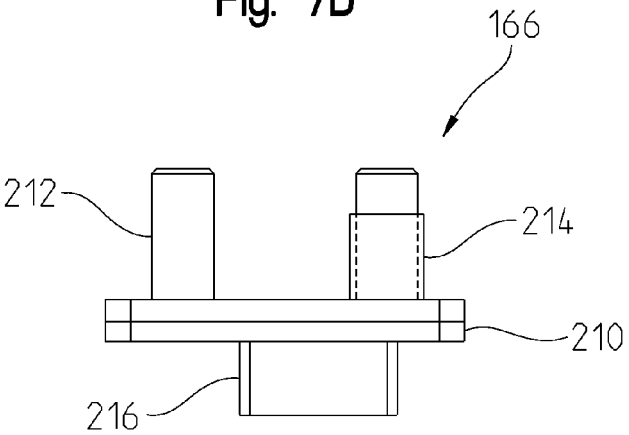
FIG. 7B is a side elevational view of the charger block of FIG. 7A.
Figure 7E:
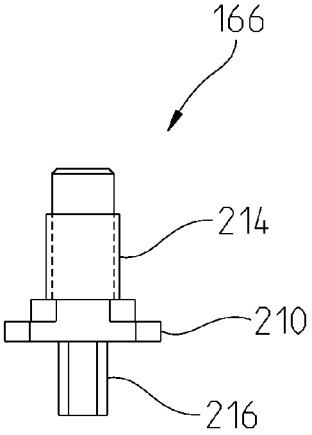
FIG. 7E is a front end view of the charger block of FIG. 7A.
Figure 7C:
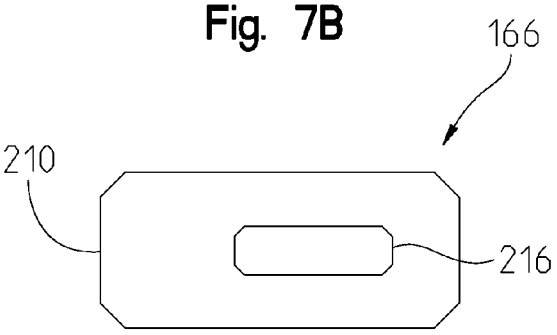
FIG. 7C is a bottom plan view of the charger block of FIG. 7A.

In the illustrative embodiment shown in FIGS. 6A and 6B, the charging bolt 32 of the MK19 grenade launcher 16 must be drawn back approximately 10.5 inches to fully charge the launcher 16. As such, both the draw length (DL) of the charger block 166 and the arc length (AL) of the sprocket 114 should be at least 10.5 inches. In order to define arc length (AL) to be at least 10.5 inches, while maintaining rotation of the sprocket 114 less than 180 degrees, the sprocket radius (R1) between the pivot axis 118 and the pitch radius of the teeth 248 of the sprocket 114 is illustratively about 3.6 inches. The angle of rotation of the handle 116 and the sprocket 114 to a full charge is illustratively defined to be approximately 167 degrees.

The typical pull force required to draw back the charging bolt 32 of the MK19 grenade launcher is about 60 lbs. For safety and ease of use by an operator, it is desirable to reduce the force necessary to pull the handle 116, and draw back the charging bolt 32, to less than 40 lbs., and preferably no more than 30 lbs. With the sprocket radius (R1) being approximately 3.6 inches, in order to maintain a maximum pull force of approximately 30 lbs., the handle radius (R2) between the pivot axis 118 and the grip 232 of handle 116 is illustratively about 8.3 inches.

With further reference to FIG. 6A, rotation of the handle 116 and the sprocket 114 in a downward and rearward direction 270 (clockwise in FIG. 6A) will pull the chain 108 over the teeth 248 of the sprocket 114 and cause the charger block 166 to move linearly in a rearward or proximal direction 272 (to the right in FIG. 6A). Similarly, rotation of the handle 116 and the sprocket 114 in an upward and forward direction 274 (counterclockwise in FIG. 6A) will pull the chain 108 off of the teeth 248 of the sprocket 114 and cause the charger block 166 to move linearly in a forward or distal direction 276 (to the left in FIG. 6A). The coil spring 190 assists in pulling the chain 108 in the distal direction 276.

Figure 9:
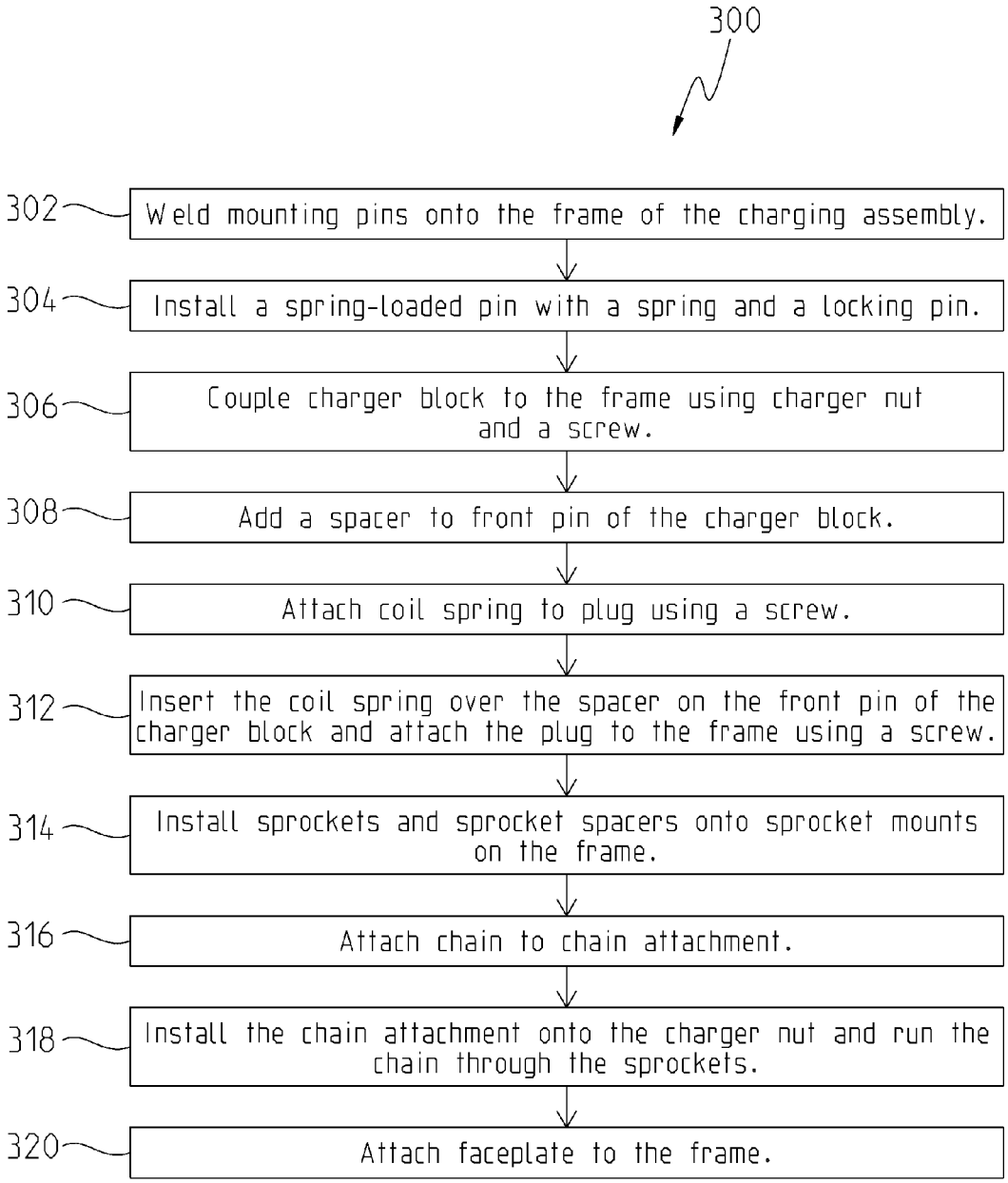
FIG. 9 is a flowchart of a method for assembling a charging assembly according to an illustrative embodiment of the present disclosure.

Referring to FIG. 9, a flowchart 300 of a method for assembling a charging assembly 104 according to an illustrative embodiment of the invention is shown. At step 302, mounting pins 122*a* and 122*b* are secured, illustratively through welding, onto the frame 121 of the charging assembly 104 such that the distance between the mounting pins 122*a* and 122*b* is substantially the same as the distance between pre-existing mounting sockets 124*a* and 124*b* that come standard on an MK19 grenade launcher 16. At step 304, install spring-loaded pin 126 in the frame 121 with spring 196 and locking pin 198. The spring-loaded pin 126 slides into an opening in the frame 121. The locking pin 198 slides through another opening in the frame 121 that perpendicularly intersects the opening with the spring-loaded pin 126. The locking pin 198 prevents the spring-loaded pin 126 from sliding out the front of the frame 121.

At step 306, charger block 166 is attached to the frame 121 using charger nut 178 and screw 182. The front side of the charger block 166 has two protruding pins 212 and 214 that slide through rectangular opening or slot 140 in the frame 121. The charger nut 178 slides onto the rear protruding pin 214 and is attached to the charger block 166 by the charger nut screw 182. At step 308, add spacer 188 to the front protruding pin 212 of the charger block 166. At step 310, attach coil spring 190 to plug 184 using screw 192. At step 312, insert the coil spring 190 over the spacer 188 on the front protruding pin 212 of the charger block 166 and attach the plug 184 to the frame 121 using screw 186. At step 314, install two sprockets 168*a* and 168*b* and sprocket spacers 172*a* and 172*b* onto the two sprocket mounts 170*a* and 170*b* on the frame 121. At step 316, attach chain 108 to chain attachment 180. The chain attachment 180 is designed to attach to the charger nut 178. At step 318, install the chain attachment 180 on the charger nut 178, and run the chain 108 through the sprockets 168*a* and 168*b*. At step 320, attach the faceplate 164 to the frame 121 using screws 176.

Figure 10:
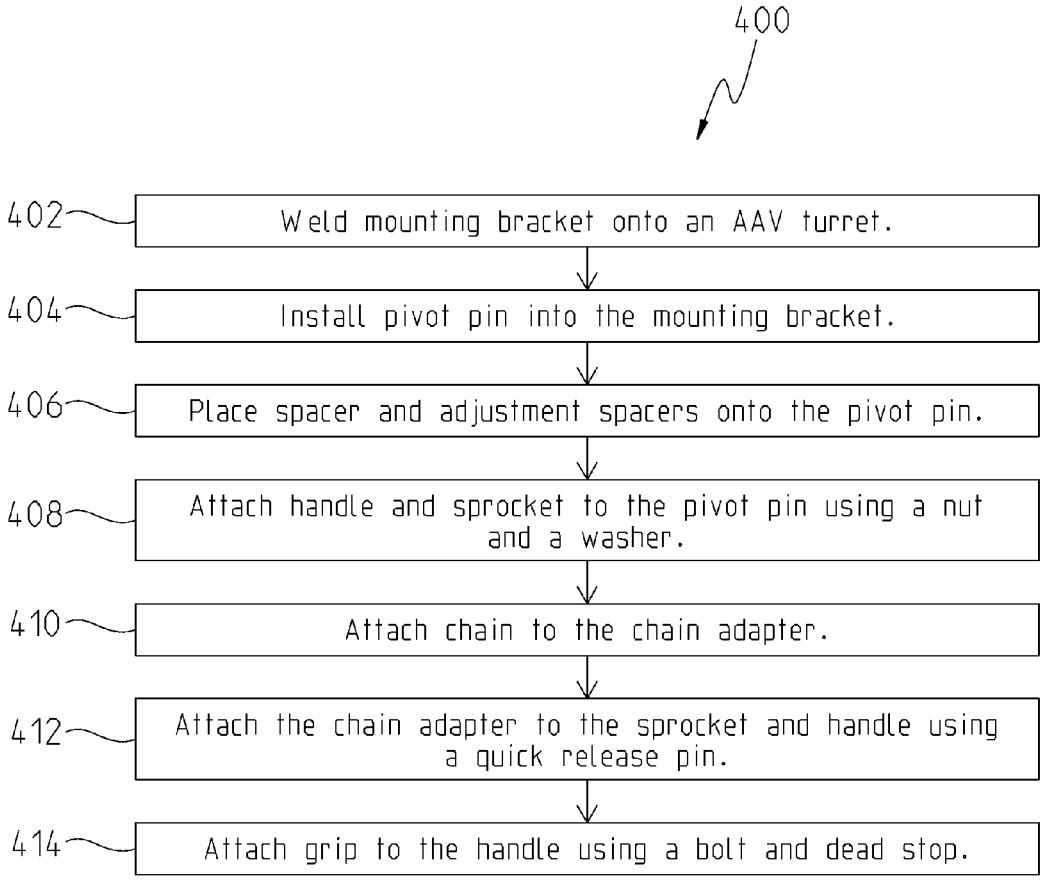
FIG. 10 is a flowchart of a method for assembling a crank assembly according to an illustrative embodiment of the present disclosure.

Referring to FIG. 10, a flowchart 400 of a method for assembling a crank assembly 106 according to an illustrative embodiment of the invention is shown. At step 402, weld mounting bracket 120 onto vehicle turret 12. The mounting bracket 120 receives bushing 247 having circular opening 249 with a smooth inner surface. At step 404, install pivot pin 224 into the mounting bracket 120. The pivot pin 224 slides into the circular opening 249 of the mounting bracket 120. One end of the pivot pin 224 has head 250 with a diameter larger than the opening 249 in the mounting bracket 120 so that the pivot pin 224 cannot slide all the way through the opening 249. The other end of the pivot pin 224 is keyed and threaded. At step 406, place spacer 226 and adjustment spacers 228 onto the pivot pin 224. At step 408, attach handle 116 and sprocket 114 to the keyed end of the pivot pin 224 using nut 242 and washer 240. At step 410, attach chain 108 to a chain adapter 142. At step 412, attach the chain adapter 142 to the sprocket 114 and the handle 116 using quick release pin 148. At step 414, attach grip 232 to the handle arm 230 using bolt 236 and dead stop 234.

Figure 11:
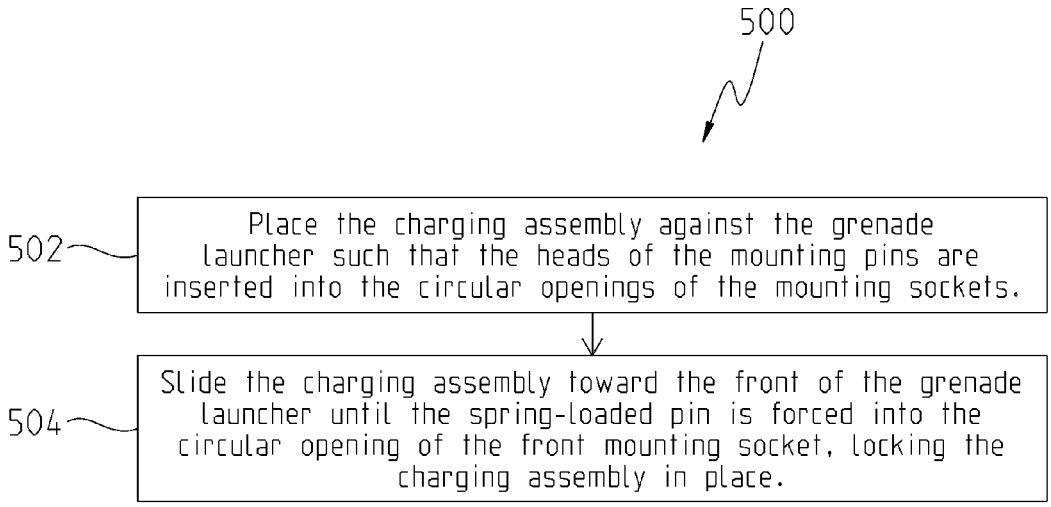
FIG. 11 is a flowchart of a method for mounting a charging assembly to a grenade launcher according to an illustrative embodiment of the present disclosure.

Referring to FIG. 11, a flowchart 500 of a method for mounting a charging assembly 104 to an MK19 grenade launcher 16 according to an illustrative embodiment of the invention is shown. At step 502, place the charging assembly 104 against the MK19 grenade launcher 16 such that the heads 136*a* and 136*b* of the mounting pins 122*a* and 122*b* on the frame 121 of the charging assembly 104 are inserted into the circular openings 130*a* and 130*b* of the mounting sockets 124*a* and 124*b* on the grenade launcher 16. At step 504, slide the charging assembly 104 toward the front of the grenade launcher 16 until the spring-loaded pin 126 in the frame 121 of the charging assembly 104 aligns with the circular opening 130*a* of the front mounting socket 124*a* such that the spring-loaded pin 126 is forced into the circular opening 130*a* and locks the charging assembly 104 in place.

Figure 4:
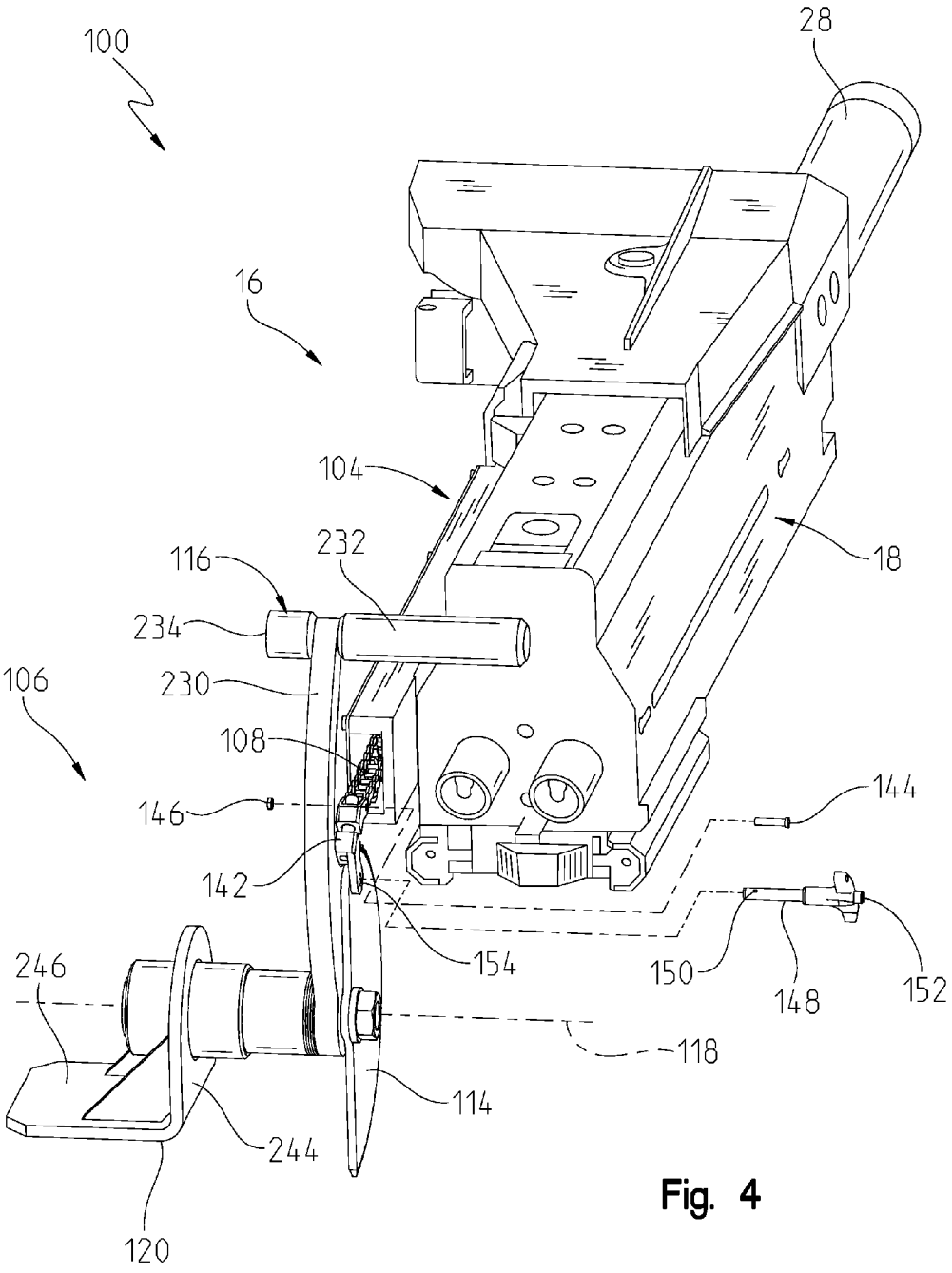
FIG. 4 is a perspective view of the system of FIG. 2, showing the coupling of the charging assembly with the crank assembly.
Figure 12:
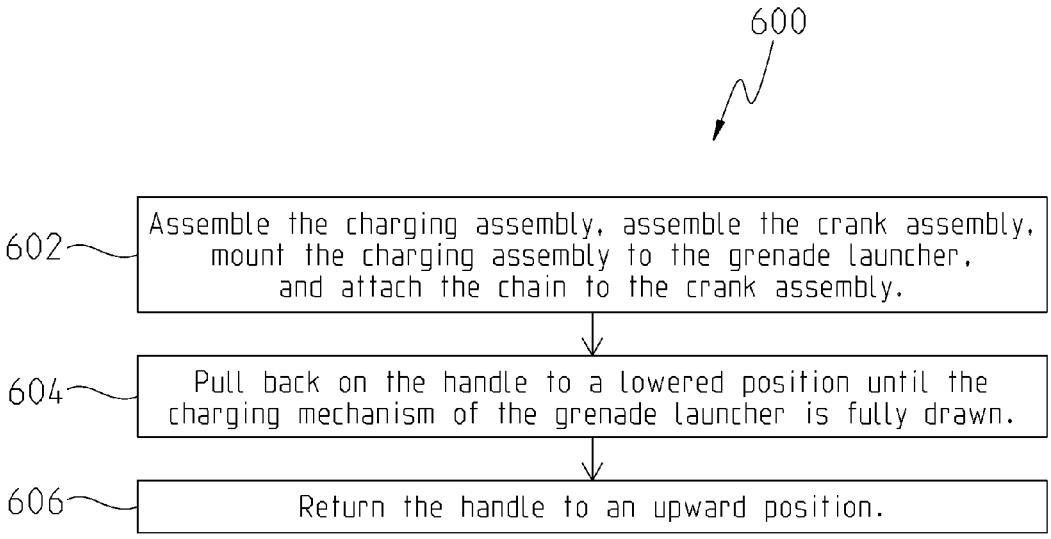
FIG. 12 is a flowchart of a method for charging a grenade launcher according to an illustrative embodiment of the present disclosure.

Referring to FIG. 12, a flowchart of a method for charging an MK19 grenade launcher 16 according to an illustrative embodiment of the invention is shown. At step 602, assemble the charging assembly 104 (FIGS. 5 and 9), assemble the crank assembly 106 (FIGS. 8 and 10), mount the charging assembly 104 to the MK19 grenade launcher 16 (FIGS. 3 and 11), and attach the chain to the crank assembly 106 (FIGS. 4 and 8). At step 604, pull back on the handle 116 until the charging bolt 32 of the MK19 grenade launcher 16 is fully drawn. In the illustrative embodiment, the charging bolt 32 will be fully drawn before turning the handle 116 one full revolution. Illustratively, rotation of the handle 116 and the sprocket 114 by 167 degrees causes the chain 108 and the charger block 166 to pull or draw the bolt 32 by approximately 10.5 inches. At step 1006, return the handle 116 to an upward position.

In other illustrative embodiments, any of the previous systems or methods may be adapted for use with any weapon with a charging bolt. For weapons without mounting sockets, the weapons will need to be machined so they have mounting sockets. For weapons with mounting sockets separated by a length different from the MK19 mounting sockets, the mounting pins on the frame need to be welded in new positions such that they align with the mounting sockets. For weapons with charging bolts that need to be drawn a longer distance (DL) than the MK19 charging bolt, the frame of the charging assembly needs to be longer such that the rectangular opening in the frame is at least as large as the drawing distance. Additionally, the radius of the sprocket (R1) in the crank assembly must be large enough that the length of the arc (AL) of the toothed portion of the sprocket is at least as long as the drawing distance (DL).

Although the invention has been described in detail with reference to certain preferred embodiments, variations and modifications exist within the spirit and scope of the invention as described and defined in the following claims.

The invention claimed is:

1. A system for charging a bolt of a grenade launcher, wherein the bolt of the grenade launcher is charged when the charging bolt is fully drawn along a linear path, the system comprising:

a charging assembly including a frame attachable to a grenade launcher, a chain supported by the frame and extending between a proximal end and a distal end, the distal end of the chain being configured to move a bolt of the grenade launcher; and a crank assembly operably coupled to the charging assembly, the crank assembly including a handle, a sprocket, and a pivot pin coupled to the handle and the sprocket for rotating the handle and the sprocket about a pivot axis defined by the pivot pin;

wherein the proximal end of the chain is coupled to the sprocket at a sprocket radius from the pivot axis such that when the handle and the sprocket rotate around the pivot axis, the chain moves the bolt along a linear draw length, and the sprocket radius has a value large enough such that rotating the handle and the sprocket by an angle of rotation less than one full rotation around the pivot axis defines an arc length sufficient to fully draw the charging bolt along the linear draw length.

2. The system of claim 1, wherein the angle of rotation is less than 180 degrees.

3. The system of claim 2, wherein the angle of rotation is between 160 degrees and 180 degrees.

4. The system of claim 3, wherein the sprocket radius is at least 3.5 inches.

5. The system of claim 4, wherein the arc length and the linear length are each at least 10 inches.

6. The system of claim 1, further comprising a charger block coupled to the distal end of the chain and including a catch configured to engage the bolt of the grenade launcher.

7. The system of claim 6, further comprising a spring configured to bias the chain in a distal direction.

8. The system of claim 7, further comprising first and second sprockets rotatably supported by the frame of the charger assembly and cooperating with the chain intermediate the distal and proximal ends.

9. The system of claim 7, wherein the charger block includes a first post extending through a longitudinally extending slot within the frame and supporting a chain attachment secured to the distal end of the chain.

10. The system of claim 9, wherein the charger block further includes a second post positioned distal of the first post and extending through the longitudinally extending slot within the frame, the second post supporting the spring having an end coupled to the frame.

11. The system of claim 1, wherein the crank assembly further includes a mounting bracket including a tab supported by a base, the tab supporting the pivot pin for rotation about the pivot axis, and the base configured to be secured to the turret of a vehicle.

12. The system of claim 1, wherein the frame of the charging assembly further includes a distal mounting pin and a proximal mounting pin configured to engage keyhole sockets formed within a side of the grenade launcher, the distal mounting pin and the proximal mounting pin each including a shaft and an enlarged head.

13. The system of claim 12, wherein the frame of the charging assembly further includes a spring loaded pin configured to be received within an opening within the side of the grenade launcher when the distal mounting pin and the proximal mounting pin are secured within the keyhole sockets.

14. The system of claim 1, wherein a pull force of less than 40 lbs. on the handle is configured to transmit at least 60 lbs. of pull force on the bolt of the grenade launcher through the charger block.

15. A system for charging a bolt of a grenade launcher, wherein the bolt of the grenade launcher is charged when the charging bolt is fully drawn along a linear path, the system comprising:

a charging assembly including a frame attachable to a grenade launcher, a flexible coupling supported by the frame and extending between a proximal end and a distal end, a charger block coupled to the distal end of the flexible coupling and configured to engage a charging bolt of the grenade launcher; and a crank assembly operably coupled to the charging assembly, the crank assembly including a sprocket coupled to the proximal end of the flexible coupling, and a handle coupled to the sprocket for rotating the sprocket about a pivot axis;

wherein rotation of the sprocket by an angle of rotation less than 180 degrees about the pivot axis by a pull force of less than 40 lbs. is configured to transmit at least 60 lbs. of pull force on the charging bolt through the charger block to fully draw the charging bolt along the linear path.

16. The system of claim 15, wherein the angle of rotation is between 160 degrees and 180 degrees.

17. The system of claim 15, wherein the charger block travels at least 10 inches along the linear path to fully draw the charging bolt.

18. The system of claim 15, further comprising a spring, wherein the flexible coupling comprises a chain, the spring configured to bias the chain in a distal direction.

19. The system of claim 18, further comprising first and second sprockets rotatably supported by the frame of the charger assembly and cooperating with the chain intermediate the distal and proximal ends.

20. The system of claim 18, wherein the charger block includes a first post extending through a longitudinally extending slot within the frame and supporting a chain attachment secured to the distal end of the chain.

21. The system of claim 20, wherein the charger block further includes a second post positioned distal of the first post and extending through the longitudinally extending slot within the frame, the second post supporting the spring having an end coupled to the frame.

22. The system of claim 15, wherein the crank assembly further includes a mounting bracket including a tab supported by a base, the tab supporting the pivot pin for rotation about the pivot axis, and the base configured to be secured to the turret of a vehicle.

23. The system of claim 15, wherein the frame of the charging assembly further includes a distal mounting pin and a proximal mounting pin configured to engage keyhole sockets formed within a side of the grenade launcher, the distal mounting pin and the proximal mounting pin each including a shaft and an enlarged head.

24. The system of claim 23, wherein the frame of the charging assembly further includes a spring loaded pin configured to be received within an opening within the side of the grenade launcher when the distal mounting pin and the proximal mounting pin are secured within the keyhole sockets.

25. A method of assembling a charging system for a grenade launcher, the method comprising the steps of:

securing mounting pins onto a frame, such that the distance between the mounting pins is substantially the same as the distance between pre-existing mounting sockets on a grenade launcher;

attaching a charger block for sliding movement within a longitudinally extending slot in the frame;

attaching a spring to the charger block;

attaching a distal end of a chain to a chain attachment;

coupling the chain attachment to the charger block;

installing a pivot pin into a mounting bracket;

attaching a handle to the pivot pin for rotation about a pivot axis;

attaching a sprocket to the pivot pin for rotation with the handle about the pivot axis; and attaching a proximal end of the chain to the sprocket.

26. The method of claim 25, further comprising the steps of:

sliding a spring-loaded pin in a hole the frame; and inserting a locking pin into the frame to secure the spring-loaded pin to the frame.

27. The method of claim 25, further comprising the steps of:

installing a pair of sprockets on the frame for rotation therebetween; and running the chain between the pair of sprockets.

28. The method of claim 25, further comprising the step of securing the mounting bracket to a vehicle turret.

29. The method of claim 25, further comprising the step of determining a radius of the sprocket large enough such that an arc length of a toothed portion of the sprocket is at least as long as the draw length of a charging bolt on the grenade launcher.

30. A method of charging a weapon comprising the steps of:

providing a charging assembly including a charger block operably coupled to a chain;

providing a crank assembly including a rotatable sprocket operably coupled to the chain of the charging assembly, and a handle configured to rotate the sprocket; and rotating the handle and the sprocket rearwardly by less than 360 degrees, wherein the charger block engages a charging bolt on the weapon and moves rearwardly by a linear draw length of the weapon.

31. The method of claim 30, wherein the handle and the sprocket are rotated rearwardly by less than 180 degrees, and the linear draw length is at least 10 inches.

32. The method of claim 30, further comprising the step of rotating the handle and the sprocket forwardly, wherein the charger block moves forwardly by the linear draw length of the weapon.

33. The method of claim 32, wherein a spring is coupled to a proximal end of the chain to assist in moving forwardly the charger block.

* * * * *